US010755517B2

(12) United States Patent
Atkinson et al.

(10) Patent No.: US 10,755,517 B2
(45) Date of Patent: Aug. 25, 2020

(54) GAMING USER INTERFACE WITH MULTI-TABLE VIEW

(71) Applicant: SG Gaming Anz Pty Ltd, Silverwater (AU)

(72) Inventors: Lyal Atkinson, Mascot (AU); Nathan Wadds, Clovelly (AU)

(73) Assignee: SG Gaming, Inc., Las Vegas, NV (US)

( * ) Notice: Subject to any disclaimer, the term of this patent is extended or adjusted under 35 U.S.C. 154(b) by 0 days.

(21) Appl. No.: 16/033,964

(22) Filed: Jul. 12, 2018

(65) Prior Publication Data

US 2019/0051102 A1 Feb. 14, 2019

Related U.S. Application Data

(60) Provisional application No. 62/544,406, filed on Aug. 11, 2017.

(51) Int. Cl.
*G07F 17/32* (2006.01)

(52) U.S. Cl.
CPC ..... *G07F 17/3211* (2013.01); *G07F 17/323* (2013.01); *G07F 17/3209* (2013.01); *G07F 17/3288* (2013.01); *G07F 17/3293* (2013.01)

(58) Field of Classification Search
CPC ..... G07F 17/32; A63F 9/24
See application file for complete search history.

(56) References Cited

U.S. PATENT DOCUMENTS 8,277,314 B2 * 10/2012 Wolf ..... G07F 17/32 463/29
2010/0227690 A1 * 9/2010 Brunet De Courssou ..... G07F 17/32 463/42
2015/0087370 A1 * 3/2015 Hematji Rajput .. G07F 17/3211 463/11

(Continued)

FOREIGN PATENT DOCUMENTS

MO I/1286 (755) 5/2014

OTHER PUBLICATIONS

SHFL Fusion, Asia 2016 Electronic Table Systems Catalogue, 2016, pp. 1-48.

(Continued)

*Primary Examiner* — James S. McClellan
*Assistant Examiner* — Kevin M Carter
(74) *Attorney, Agent, or Firm* — Banner & Witcoff, Ltd.

(57) ABSTRACT

Aspects disclosed herein may provide a gaming user interface that allows users to view and interact with multiple gaming instances from a single screen. When presenting multiple gaming instances, the user interface may utilize a compact panel display of the gaming interface offering reduced functionality and information about each gaming instance. Each compact panel display may include functionality allowing the user to interact with a corresponding gaming instance, such as by allowing the player to place a wager on the outcome of the game. The user may be able to select a control on the user interface to expand a particular (Continued)

panel corresponding to a particular gaming instance. Responsive to selection of the control, the user interface may expand the particular panel to replace other panels of the multi-table view. The expanded panel may offer additional functionality and information that is not available in the compact panel.

17 Claims, 11 Drawing Sheets

(56) References Cited

U.S. PATENT DOCUMENTS

2015/0221185 A1* 8/2015 Dunaevsky ..... G07F 17/3293 463/13
2015/0339884 A1* 11/2015 Chun ..... G07F 17/3276 463/25
2016/0166917 A1* 6/2016 Huang ..... A63F 1/00 273/292

OTHER PUBLICATIONS

Asia Electronic Table Solutions Catalogue, Jun. 2011, pp. 1-18, ShuffleMaster Asia Limited.
Casino Life, Feb. 2016, Peter White, United Kingdom.
Casino Life, vol. 13—Issue 111, Nov. 2016, Peter White, United Kingdom.
Electronic Table Systems, May 2012, pp. 1-25, ShuffleMaster Asia Limited.
"Enjoy a live multi-table game experience from a single player station—Baccarat", 2016, pp. 1-2, Fusion Hybrid.
Enjoy a live multi-table game experience from a single player station—Stadium Blackjack, 2016, pp. 1-2, Fusion Hybrid.
"Fusion Virtual—Play Up to Four Different Games at One Terminal!", 2015, ShuffleMaster.
"Play Up to Four Different Games at One Terminal!", Apr. 2017, Fusion Virtual Multigame.
"Rapid Fusion", 2012, SHFL entertainment.
Rapid Multigame Graphical User Interface Screens, 2012, Shuffle Master Asia Ltd.
"Stadium Blackjack—Start the Same, Play Your Own Game!", Jul. 2016, ShuffleMaster.

* cited by examiner

600

750

GAMING USER INTERFACE WITH MULTI-TABLE VIEW

CROSS-REFERENCE TO RELATED APPLICATIONS

This application claims priority as a non-provisional of U.S. Provisional Patent Application No. 62/544,406, entitled "Gaming User Interface with Multi-Table View," filed on Aug. 11, 2017, the entirety of which is incorporated herein by reference.

COPYRIGHT

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

FIELD OF USE

Aspects of the disclosure relate generally to computer software and hardware associated with electronic gaming systems. More specifically, aspects of the disclosure may provide a user interface offering a multi-table view, allowing players to observe and play multiple instances of one or more games concurrently.

BACKGROUND

Games, including games of chance and games of skill, are increasingly offered in electronic form. Classic casino games, such as Blackjack, Baccarat, Sic Bo, and Roulette, have been adapted for presentation to users on electronic gaming devices. User interfaces on electronic gaming devices may be designed to recreate the visual experience associated with playing these games in person. A user interface provides players with a display of the available betting options and allows the user to place wagers on the outcome of the game. The games which the user interfaces display may correspond to actual instances (e.g., tables) of a physical game operated by a live dealer, or may correspond instead to a virtual, simulated instance of the game.

As electronic gaming devices have increased in popularity, operators have developed machines which could support several different types of games. Users may be presented with a first user interface screen prompting the user to select a type of game. After selecting a game type, the electronic gaming device may present the user with a display of that game and allow the user to place bets on outcomes of that game. The user interface may allow the user to switch to a different game type.

Players of such games may seek to track past results of a game in order to assess trends in the results. Some game operators may provide users with the means to track such trends, or may otherwise indicate past results through the implements of the game. Further, as electronics have become more widely utilized, systems have been developed to track the results of a particular casino game and present this information to current and prospective players. For example, a physical roulette table may be equipped with an electronic device that tracks the result of each spin of the wheel. This information may be compiled and processed to present various statistics of interest to the players, such as the relative percentage of red numbers versus black numbers, or to indicate the last ten numbers that have hit. This information may be prominently displayed at or near the table for the benefit of current and prospective players.

Each game may offer players time to place wagers prior to performing a round of the game (such as a spin of the roulette wheel). After spinning the wheel, there may be an additional period of time to confirm the result and make payments on winning wagers. Further, each game may limit the number of ways in which the player may participate, such as through only allowing one hand per player or having a maximum number of hands per table.

Players may desire to participate in more than one game at a time to increase action or experience multiple independent results. Current systems may allow players to participate in several games. However, the user may be required to toggle between different user interfaces for each game the player wants to participate in. Limited screen size and resolutions may make it difficult to display information associated with multiple game instances concurrently. As a result, current systems may present user interfaces including information about a particular focused game instance while allowing the user to navigate to other game instances. A player may be required to switch to a focused display of a particular game to place a wager or otherwise participate in that game, and cannot make bets on another game without leaving that focused display. It may be difficult in such systems for players to assess trends for each game in deciding which games to play. And players may not enjoy switching to another user interface to view one game while they have a pending wager in a second game.

Aspects described herein may address these and other problems associated with electronic gaming devices, and may eliminate the above mentioned disadvantages of current systems by providing user with a user interface having multi-table view features. Features described herein provide many advantages over current systems, such as providing an improved display of trend information associated with multiple game instances. This may allow users to assess the state of many games concurrently and provide them more information for use in determining which games to play. Other advantages may include allowing users to participate in multiple game instances concurrently from a single user interface screen. This may improve user experience by allowing the user to observe activity in several games at once, without requiring the user to focus on one particular game result. This may also encourage a greater level of activity from a user, as the user may be encouraged to wager on more game instances, resulting in a higher total wager. User interfaces implementing one or more aspects described herein may allow users to more efficiently and accurately identify trends in multiple game instances on an electronic gaming device through. Some aspects may improve speed, accuracy, and usability of the electronic gaming device and the user's interaction therewith by presenting the user with relevant information corresponding to multiple game instances concurrently, while still supporting a complete view of an individual game instance.

SUMMARY

The following presents a simplified summary of various aspects described herein.

This summary is not an extensive overview, and is not intended to identify key or critical elements or to delineate the scope of the claims. The following summary merely presents some concepts in a simplified form as an introductory prelude to the more detailed description provided below.

A user interface of an electronic gaming device, according to some aspects described herein, may present a user with a panel view showing the user multiple game instances and may allow the user to directly place wagers through the displayed panels. Each panel may correspond to a particular game instance, and may display information and functionality associated with that instance. Some panels may be configured to display trend information about their respective game instance to assist the user in determining which games to play. The user interface may also allow a user to view additional detail about a particular game instance, expanding the panel corresponding to the particular game instance to replace the other panels. The expanded panel may present additional information and functionality associated with the particular game instance.

According to some aspects, an electronic gaming device may provide a game selection menu user interface implementing a multi-table view feature as described further herein. The electronic gaming device may operate to provide this game selection menu by displaying a plurality of game type tabs in a tab display region on a display device. Each tab of the plurality of game type tabs may correspond to a respective different game type, such as Blackjack, Baccarat, Roulette, Sic Bo, and the like. The electronic gaming device may receive user input, through an input device, indicative of a selection of a first game type for the game type tabs. The user input may be a user selection of first tab of the plurality of game type tabs that corresponds to the desired game type.

In response to the user selection, according to some aspects, the electronic gaming device may display a plurality of playable view panels in a playable view region adjacent to the tab display region on the display device. The playable view panels may each correspond to a different respective game play instance of the selected game type. Paging controls may be provided on the user interface to allow the user to view additional instances of the selected game type. Each playable view panel may include controls or other elements supporting user participating in the respective game play instance. The playable view panels may be operative to allow a user to directly participate in the games, such as by placing a wager on a result of the game, without needing to advance to a separate user interface corresponding to that game. The electronic gaming device may receive user input within one or more of the playable view panels indicative of the user placing a wager on the corresponding game play instance.

One or more of the playable view panels may include a trend display element based on past game play results of the corresponding game play instance. For example, inactive panels in which the player is not participating may devote a portion of their display region to displaying a chart or other information illustrating recent results of the game. The playable view panels may also include a timer display element that indicates a remaining time before a next round of the game is performed. The timer element may be updated to count down to the next round, and the trend display element and/or other portions of the playable view panel may be updated in response to a new result of the game.

According to some aspects, the user interface may allow the user to select a particular panel for expansion, so that the user may view additional information and/or functionality associated with the underlying game play instance. The electronic gaming device may receive, through the input device, user input indicative of a selection of a particular panel of the plurality of playable view panels for expansion. For example, each panel may include a control or other user interface element for the user to select (e.g. tap or click on) to indicate that the panel should be expanded. Responsive to the user input selecting a panel to expand, the electronic gaming device may expand the panel to replace other panels of the plurality of playable view panels within the playable view region (or otherwise adjust the display to include proportionally more information about the selected game play instance). The expanded panel may include additional game content that was not depicted prior to the second panel being expanded. The additional game content may include additional information and/or additional functionality that was not available in the selected playable view panel prior to expansion. For example, the additional game content may include a bonus bet control that was not part of the compact view of the playable view panel. As another example, the additional game content may include a more detailed trend chart displaying additional statistics that were not part of the compact view of the playable view panel. As still another example, the additional game content may include video content (live and/or prerecorded) of a dealer associated with the game instance.

Other regions may be included on the user interface of the electronic gaming device, such as a credit region and/or a menu region, which may be displayed adjacent to the tab display region and the playable view region. The credit region may include information associated with a player balance and current activity across the various game instances in which the player is participating. The credit region may also include one or more controls that allow the user to adjust their wagers, such as through controls corresponding to multiple chip designations.

BRIEF DESCRIPTION OF THE DRAWINGS

These and other features, aspects, and advantages of the present disclosure will become better understood with regard to the following description, claims, and drawings. The present disclosure is illustrated by way of example, and not limited by, the accompanying drawings in which like numerals indicate similar elements.

DETAILED DESCRIPTION

Aspects disclosed herein may provide a gaming user interface that allows users to view and interact with multiple gaming instances from a single screen. The user interface may allow a user to select a desired game type, and may present the user with multiple instances of that game type. When presenting multiple gaming instances, the user interface may utilize a compact panel display of the gaming interface offering reduced functionality and information about each gaming instance. Each compact panel display may include functionality allowing the user to interact with a corresponding gaming instance, such as by allowing the user to place a wager on the outcome of the game. The user may be able to select a control on the user interface to expand a particular panel corresponding to a particular gaming instance. Responsive to selection of the control, the user interface may expand the particular panel to replace other panels of the multi-table view. The expanded panel may offer additional functionality and information that is not available in the compact panel.

Features described herein provide many advantages over current systems as discussed above, such as providing an improved display of trend information associated with multiple game instances and allowing users to participate in multiple game instances concurrently from a single user interface screen. Before discussing these features in further detail, discussion will turn to an example gaming system and network used in some implementations, as depicted in FIGS. 1 and 2.

Figure 1:
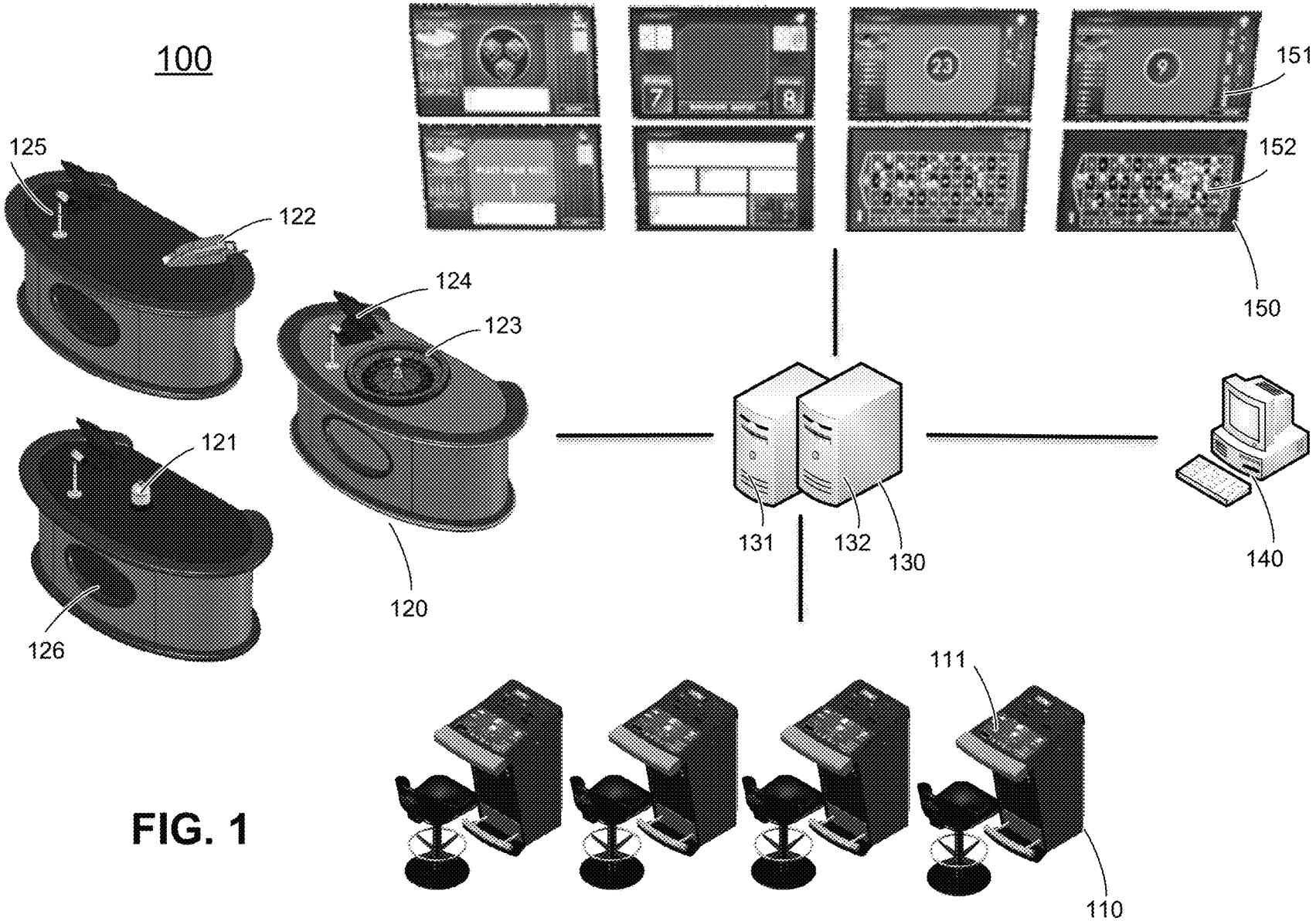
FIGS. 1 and 2 illustrate example systems in which various features described herein may be implemented.
Figure 2:
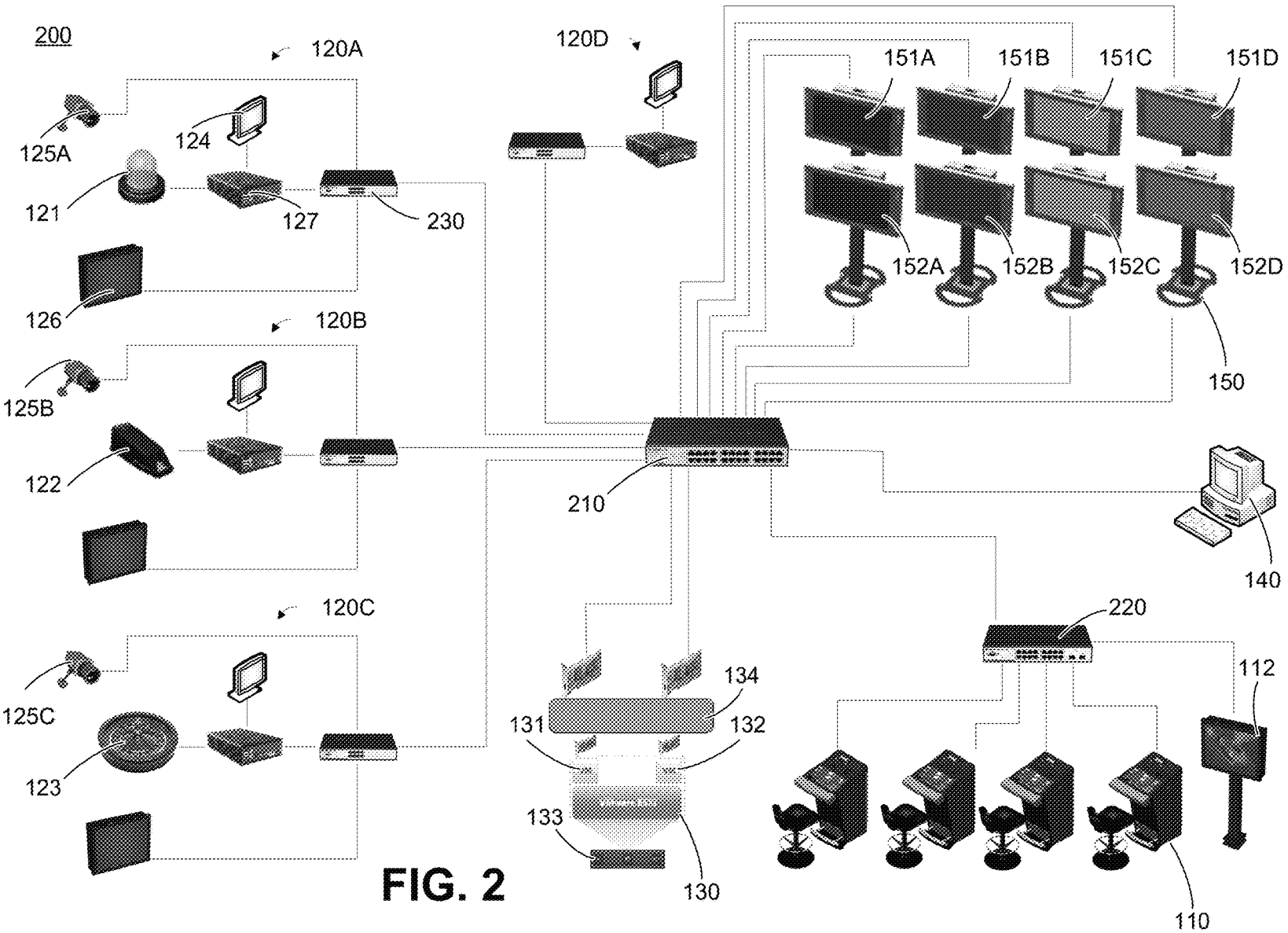

FIG. 1 depicts an example of a gaming system 100 as used in some implementations of one or more aspects described herein. The gaming system 100 may comprise a bank of player terminals 110 arranged around one or more dealer stations 120, one or more processors defining a central controller 130, an administration terminal 140, and a bank of large screen community displays 150 or a single large screen community display.

Each of the player terminals 110 may include a video display including a touchscreen interface 111 to enter bets and display the results of each game provided on the gaming system. While not explicitly annotated in FIG. 1, each player terminal 110 may include a card reader, a ticket reader and/or printer, and a note validator to allow the player to transfer monetary funds to and from the player terminal 110.

In the example illustrated in FIG. 1, the gaming system 100 includes three dealer terminals or stations 120 provided on separate gaming tables, though any number of dealer terminals or stations 120 may be provided. Each dealer station 120 may be configured to run a game provided on the gaming table and may include a dealer video touchscreen interface 124 to allow the dealer to interact with the dealer station 120 to administer the game and for other purposes. Each dealer station 120 may include one or more physical objects for rendering game outcomes and a video camera 125. The physical objects used to generate random game outcomes may be in the form of a dice shaker 121, card shoe 122 adapted to read the cards dealt from the shoe to form game hands, roulette wheel 123, and/or any other type of gaming device that generates random or pseudo-random results. The video camera 125 may be positioned at the dealer station 120 to provide a live visual feed of the game's progress to the player terminals 110 and an associated display in the bank of large screen displays 150. An electronic placard display 126 may also be provided to further distinguish each gaming table when more than one gaming device of the same type is provided on separate tables of the gaming system 100.

The central controller 130 may comprise a gaming server 131 and gaming database 132 and one or more processors. The central controller 130 may act as an interface between the player terminals 110 and dealer terminals 120 of the gaming system 100. A wired or wireless communication network provides for communication between the controller 130 and the gaming terminals 110

The administration terminal 140, also connected to the network, may be used to initially configure the gaming system 100, control various applications, and monitor the gaming system 100.

The bank of large screen displays 150 may be controlled by the controller 130 to display information such as game content, game progress information and historical outcome information. The displays may be arranged as rows of top and bottom display screens 151, 152 to show the status and statistics of each game, respectively.

FIG. 2 depicts a network 200 of the gaming system of FIG. 1. Network 200 may include switch 210 (which may be a 24 port Power over Ethernet (PoE) switch), switch 220 (which may be a 16 port PoE switch), and switches 230 (which may be four 8 port PoE switches) that communicatively connect player terminals 110, dealer terminals 120, administration terminal 140, and the bank of large-screen displays 150 to central controller 130. A display screen 112 may also be connected to the network 200 and located at the end of each row of player terminals 110 to display game proceedings and information from each game provided by the system 100.

In the embodiment shown, a VMware® ESXi server is used as the central controller 130. VMware® ESXi is a hypervisor system provided by VMware, Inc of Palo Alto, Calif. and may allow the gaming server 131 and gaming database 132 to be supported as virtual devices on one physical device 133. In this case, gaming server 131 and gaming database 132 may be communicatively connected to the network via a virtual switch 134.

Each dealer station 120A-120D may include a touchscreen interface 124 and a game controller 127, for example in the form of a mini-ITX computer, to allow a dealer to interact with and administer the game running on the dealer terminal 120. While not shown, an identification device, such as a magnetic or smart card reader, may be installed on each dealer station 120. To access the dealer station 120A-D a dealer may be required to swipe a personal authorization card when logging on to confirm they are authorized to administer the game. A pit boss may also be required to swipe their own authorization card through the card reader to authorize certain actions taken by the dealer during the administration of the game as a means of preventing collusion between the dealer and players.

An electronic placard display 126 may be provided on each gaming table to display a unique sign (such as a symbol, letter, numeral, character, etc.) that is associated with each game so players may readily identify which table they are betting at when two or more games of the same type are provided on the gaming system. Each table may also use a differently colored playing surface, in which case color may be used in the background of the placard display 126 and large screen displays 150 to further identify and distinguish the video feed, progress information and historical outcome information of each game.

The game controller 127 of each dealer station 120A-120C may be communicatively connected to a respective physical gaming device/object 121, 122, 123 to allow gaming results to be determined and directly communicated to the game controller 127, which the dealer confirms by using touchscreen 124. It is to be appreciated that game controller 127 may include an automatic play mode such that inputs from physical devices 121, 122, 123 are replaced by inputs from a random or pseudo-random number generator operating within game controller 127 such that a dealer is not required to be present at the gaming table 120 to manipulate physical devices 121, 122 or 123 and to administer the game. Also as described below the system may support switching to an alternate, virtual mode while still supporting the player terminals 110. Thus when there is no physical dealer the games may still be operated.

Cameras 125A-125C may be positioned over respective gaming devices 121, 122, 123 at each dealer station 120A-C to provide a live feed of game action that is relayed to the player terminals 130 and large-screen displays 151A-151C via the network 200. Large-screen displays 151A-151C may also be used to display all the bets placed by player terminals 110 which are participating in the game, as well as the current status of the game (i.e. new game, place your bets, no more bets, winning result). Large-screen displays 152A-152C may provide additional information, such as game statistics, previous winning results, and minimum and maximum bets of the game running on the game controller 127 of each respective dealer station 120A-120C.

In accordance with one or more alternate embodiments, game controller 127 of dealer station 120D may be configured to run, when the system is in a second or virtual mode, a virtual game that is displayed on large-screen displays 151D and 152D as well as at each participating player terminal 110. Dealer station 120D, in the virtual mode, may be configured to not use and/or disable the physical gaming device 121, 122, 123, since all game results are automatically generated using a random number generator (RNG) module operating on the processor of the game controller 127 of dealer station 120D, or, in some embodiments, on the game controllers 127 of the individual dealer stations 120A-120C.

Figure 3:
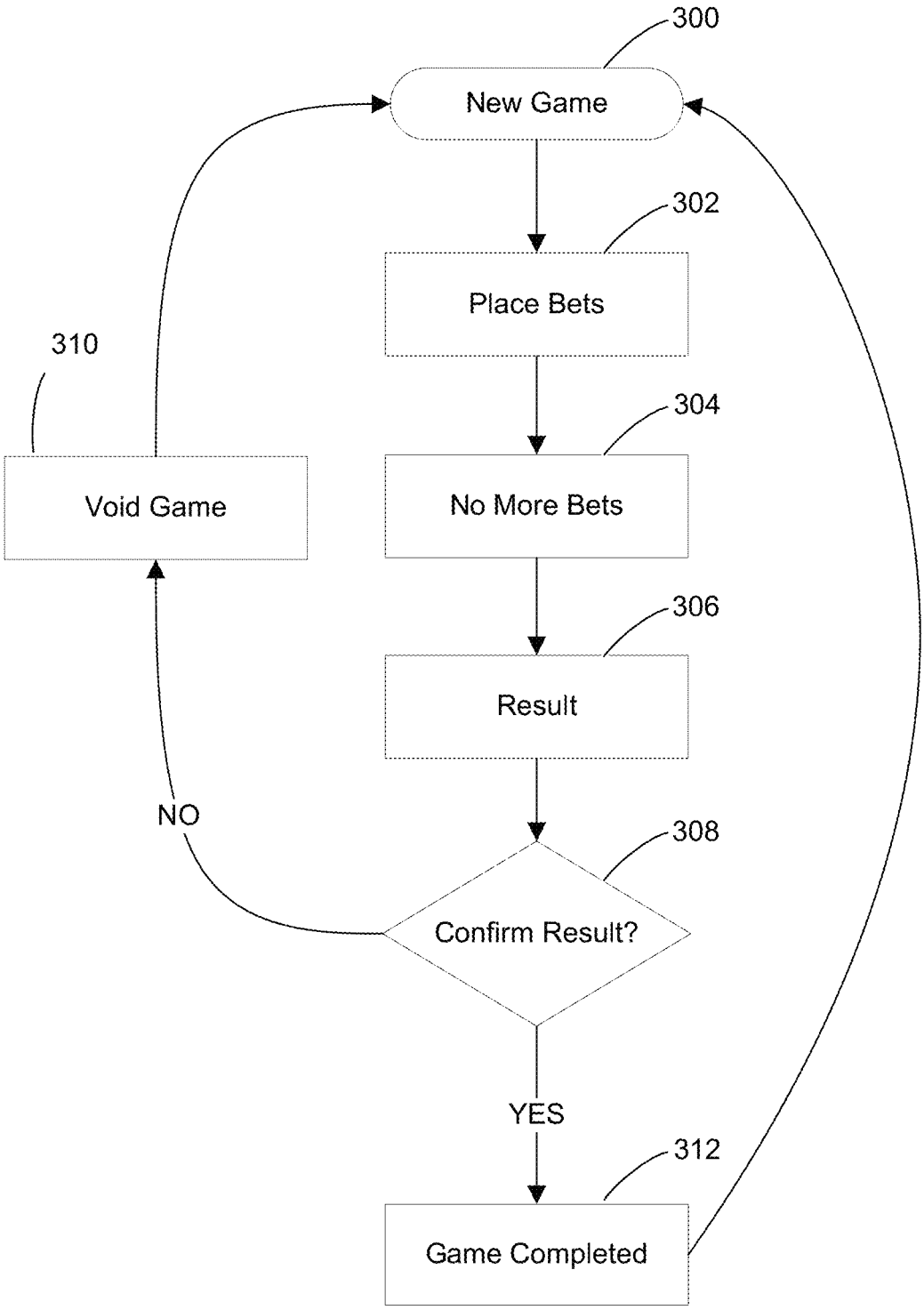
FIG. 3 illustrates an example method according to which game play may proceed, according to some aspects described herein.

FIG. 3 illustrates a logical flow diagram generally depicting the steps associated with a method of a gaming cycle of a game provided, for example, on a gaming system of FIG. 2. As depicted, the game goes through a number of game states during the game cycle. The dealer may initiate a new game at block 300 by pressing a "New Game" button on the touchscreen of a dealer station 120, which may be any of dealer stations 120A-120C. The associated game controller 130 sends a "New Game" notification to all active player terminals 110 associated with the dealer station 120 according to the game selected by each player at an active player terminal 110.

At block 302, a timer, which may be universally synchronized over the network with all of the player terminals 110 and the dealer station 120, initiates a timed countdown. A "Place Your Bets" message may be displayed on all active player terminals 110 associated with the dealer station 120 according to the games selected by each player at an active player terminal 110. The countdown may be started at the game controller 127 and the central controller 130 may be informed to change the gaming state to a count down. During the period provided by the timer, each participating player may place selected wagers on the various propositions offered by the game. These propositions may include traditional wagers as are well known with respect to the chosen game as well as bonus wagers or proposition side wagers. The manner for placing the wagers will be discussed below.

When the time to place wagers has timed out, central controller 130 will be informed at block 304 that no more wagers are to be accepted and each player terminal display is controlled to display "No More Bets".

As an alternative to using a timed countdown, the dealer may have direct control over when to close the betting period. For example, block 304 may be initiated by a dealer selecting a command on the interface 124 of the dealer terminal 120 for the game controller 127 to close the betting period, which is then relayed to the player terminals 110 by the central controller 130. As another alternative to using a timed countdown, the betting period may be closed by an action or condition detected by the physical gaming device used to determine the game result. For example, the game controller 127 may be configured to close the betting period once the card shoe 122 detects a card has been drawn. Similarly, the game controller 127 may be configured to close the betting period of a roulette game when the roulette wheel 123 detects a ball drop condition.

Subsequent to the close of the betting phase (or partially during the betting phase, for example in the case of roulette) a physical dealer at the dealer station 120 may operate the game, including using physical objects 121, 122, or 123, to render the game outcome. For example, if the game is baccarat, the dealer deals physical cards from a shoe to form the banker and player hands, as is well known in connection with the game. As the cards are removed from the shoe 122, the suits and values of the cards are read by the shoe. That data is sent to controller 127, which controls the community video displays 151, 152 to display graphics representing the ranks and suits of the cards. The displays at participating player terminals 110 likewise display the cards. The running totals for the sums of the player and banker hands may be displayed as well.

At block 306, the results or outcome of the game may be displayed at the community displays 151, 152, at the dealer terminal 124 and at each associated player terminal 110. In one or more embodiments, each participating player terminal 110 may be controlled to initially display the cards of the player hand face down until revealed by action of the player. For example, the player terminal touch screen display 124 may be configured to determine a "squeeze" gesture to gradually reveal the cards of the player hand in order to increase the suspense of the play.

At block 308, the dealer confirms the result. If there is no discrepancy, the result stands. If there has been an error, misplay or other discrepancy, the dealer may void the play at block 310. Otherwise, at block 312, the game outcome stands. Controller 130 resolves all player wagers and the game is completed. Players who wagered on winning propositions would be paid based upon their wagers and those wagering upon losing propositions would lose their wagers.

Further embodiments may include one, some, or all of the following: The acts of the dealer may be carried out by a visual representation of a dealer, the visual representation being generated and/or displayed by a computer. The visual representation may be a virtual person (e.g., an animation), or may be a transmission (e.g., a live or pre-recorded video) of an actual person. The visual representation may be part of an online gaming experience of the disclosed game. The acts described in this disclosure associated with a dealer, including dealing cards, displaying or turning cards over, receiving or paying bets, or any other actions, may be represented in any way when used in an online environment. For example, the cards associated with a dealer action, described as being dealt or otherwise handled by a dealer, may appear as virtual cards or as transmitted pictures of physical cards. This may include a display of virtual card decks where each deck, individual card, and hand is displayed to an online player in a manner consistent with the game play disclosed herein, but may or may not include a visual representation of a dealer with the cards. Likewise, betting activity may be displayed in any manner to a player, including, but not limited to, virtual chips, betting pools, numbers, or other indicia of a bet amount.

The online experience may involve players playing remotely (e.g., in a different physical location) from the dealer, remotely from the location of a game server, or remotely from both, interacting through a networked connection that may include, but is not limited to, the Internet. The online game play may involve players who are also physically remote from each other. Remote connections may use networks involving several types of network links including, but not limited to, the Internet. Networked connections allowing physically remote players to play a game using a game server or system may be part of an implementation of a virtual or online gaming environment.

Live, electronic, or online-implementations of the methods described herein may be configured for administration as either "play-for-pay" embodiments or "play-for-fun" embodiments. In play-for-pay embodiments, wagers having real-world monetary value are received and payouts having real-world monetary value may be distributed. Play-for-pay embodiments may include "house-banked" embodiments, "player-banked" embodiments, and "player-pooled" embodiments. In house-banked embodiments, payouts are paid by, and losses are retained by, the game administrator (e.g., a casino or other gaming establishment). In player-banked embodiments payouts are paid by, and losses are retained by, a player acting as the game administrator, and the casino or other gaming establishment may profit from the game by, for example, "raking" the wagers (i.e., retaining a portion of the wagers for the house) or charging a seat or room fee in exchange for making the venue available for a predetermined time. In player-pooled embodiments (e.g., "player-pooled progressive" configurations, "dividend refund" configurations), wagers are raked by the game administrator and pooled into a pot from which payouts are paid, which pot is eventually distributed to at least one player; thus, the game administrator retains only the raked amounts. Unlike play-for-pay embodiments, play-for-fun embodiments (e.g., "free play-for-fun" configurations, "social play-for-fun" configurations) involve receiving wagers having no real-world monetary value and distributing payouts having no real-world monetary value.

The actions described in this disclosure as the acts of a player, including betting, card selection (if any), card evaluation, card discards (if any), play elections, or any other actions, may be carried out over a network where the indicated actions are received as input to a device. The input-receiving device may be physically remote from the game server or game host and connected over a long-distance network, but may also be implemented over a wired or wireless LAN in one building, or even in one room, for example. In one embodiment, game play generated at the server or host location may be displayed on the same device receiving input. In some embodiments, game play may be conveyed to remote players in devices separate from the devices receiving input from a player, such as public screens or publicly broadcast data about a game coupled with individual or private input devices. The reception of an input at a device may be accomplished through any technology adapted for such a purpose including, but not limited to, keypads, keyboards, touchpads, touch screens, buttons, mice, optical location devices, eye movement/location detectors, sound input devices, etc. When discussing a device, it is to be understood the device may comprise multiple components and be complex, including hardware components combined with firmware and/or software, and may itself be a subcomponent of a larger system.

Having discussed an example gaming system in which aspects described herein may be implemented, discussion will now turn to a gaming user interface having a multi-table view. As explained above, one or more aspects of the present disclosure may provide a user with a user interface having playable view panels corresponding to multiple game instances. Each playable view panel may display information about a corresponding game instance and may allow the user to directly place wagers on the respective game instance without requiring the user to navigate to a focused display of that game instance. Thus, a user may be able to participate in multiple games concurrently, and may be able to quickly and easily place bets and observe results of multiple games in a single view without having to switch screens.

Figure 4:
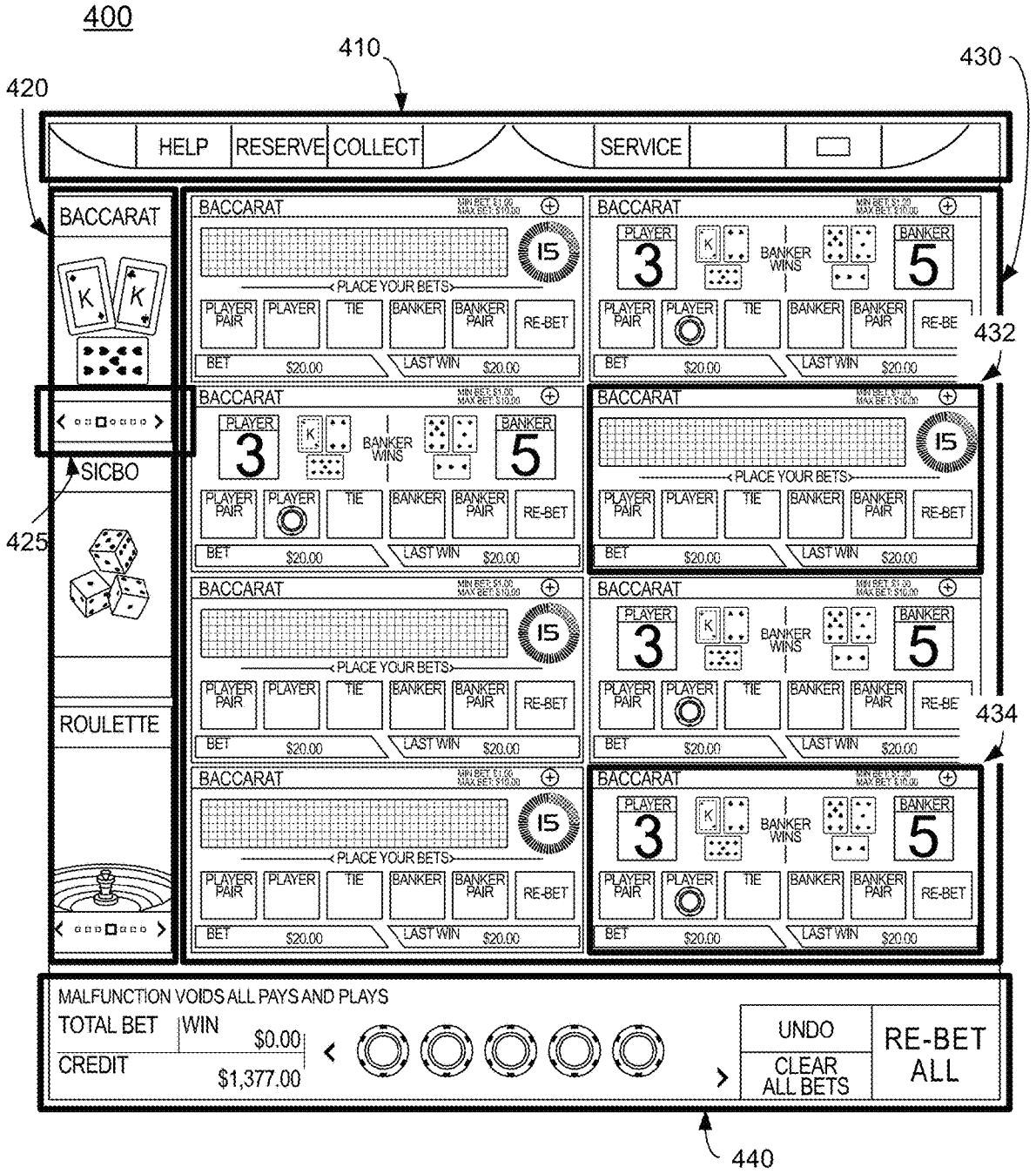
FIG. 4 illustrates an example user interface with a multi-table view, according to some aspects described herein.

FIG. 4 depicts an illustrative user interface 400 according to aspects described herein. User interface 400 may be provided by an electronic gaming device, such as player terminal 110 via display device 111 of FIG. 1. Other electronic gaming devices which may implement user interface 400 may include any suitable computing device, such as a desktop computer, laptop computer, mobile device, tablet, and the like. User interface 400 may be displayed on a display device coupled to the electronic gaming device, such as a touchscreen or other suitable display.

User interface 400 may be divided into display regions configured to convey information to the user about the games available to the user. For example, user interface 400 may include a menu region 410, a tab display region 420, a playable view region 430, and a player credit region 440.

Menu region 410 may provide system functions to the user. Menu region 410 may be a system bar comprised of system buttons allowing the user to access various features related to the gaming system generally rather than a particular game play instance. For example, menu region 410 may include a help control that allows the user to view instructions on how to use the electronic gaming device to play the games. Menu region 410 may also include controls allowing the player to reserve a terminal or cash out.

Tab display region 420 may present available game types for selection by the user, similar to a game selection menu. For example, tab display region 420 is depicted as offering three game types: Baccarat, Sic Bo, and Roulette. The present disclosure is not limited to these three example game types, and implementations according to aspects herein may offer other game types such as Blackjack, Craps, Big 6, Three Card Poker, Pai-Gow Poker, and the like. Available game types may include those suitable for a multi-view display, such as those that can reasonably be played in a compact view panel, and also other games not suitable for a multi-view display, such as games that require display of a large amount of information to remain playable or are not conducive to concurrent play with other games. For example, the electronic gaming device may allow a player to select to play an electronic slot machine but may not support multi-view display of the slot machine. According to some implementations, the user may be able to switch game types through a single tap on a displayed tab corresponding to the desired game type.

Playable view region 430 may present the user with a display of the currently selected games. As illustrated in FIG. 4, user interface 400 may be configured to provide a multi-table view (or multi-view), allowing the user to view multiple tables at one time. In the multi-table view, playable view region 430 may include one or more playable view panels corresponding to respective game play instances, such as playable view panels 432 and 434. That is, the operator may offer one or more game instances of a respective game type, either as physical tables or virtual tables, and playable view region 430 may display playable view panels corresponding to the available game play instances for the selected game type. For example, if the user selects the Baccarat game type, playable view region 430 may display multiple Baccarat games in playable view panels.

Each playable view panel may correspond to a compact user interface corresponding to the underlying game instance, and may omit some functionality and/or information that is displayed on a more complete, expanded user interface corresponding to the game type. Each playable view panel may include controls and other elements that allow the user to place wagers or otherwise indicate participation in a game. The multi-table view provided by the plurality of playable view panels may allow users to play multiple games from a single screen, without requiring the user to drill down into (or expand) a particular game instance.

Playable view panels, such as playable view panels 432 and 444, may have content corresponding to the game type of the underlying game play instance, and may have different content depending on whether the player is currently involved in the game. The content of the playable view panels will be discussed further below with respect to FIGS. 5A and 5B.

Figure 5A:
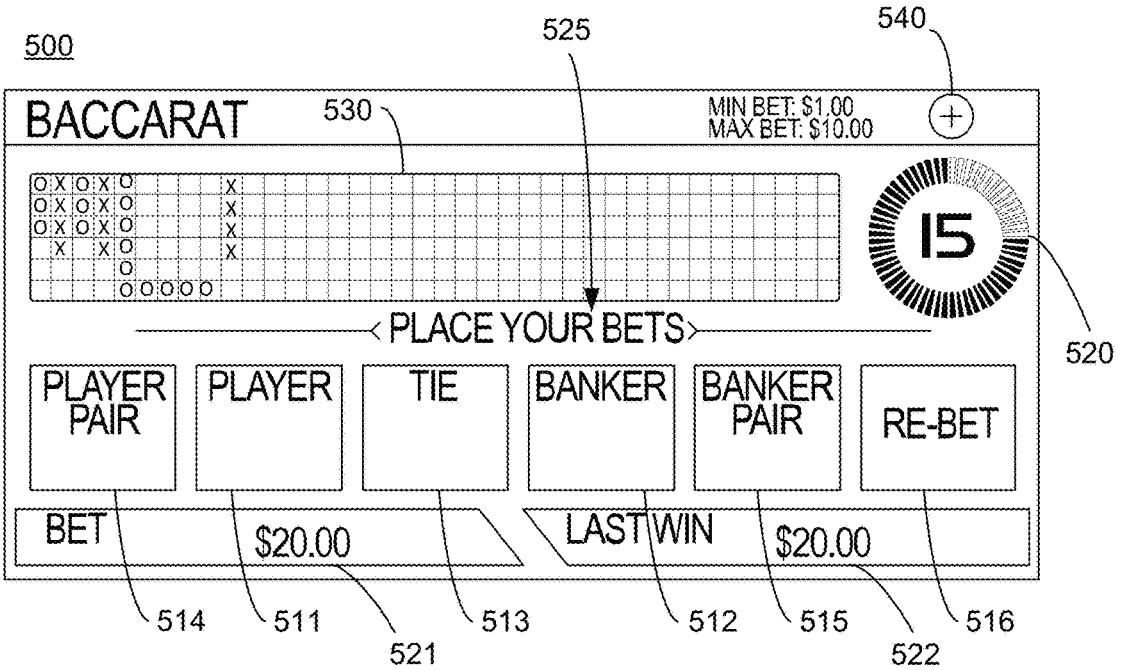
FIGS. 5A and 5B illustrate additional detail of some elements of an example user interface with a multi-table view, according to some aspects described herein.

FIG. 5A depicts an illustrative playable view panel 500 corresponding to the Baccarat game type, in an inactive state. That is, the user is not presently participating in the underlying game of Baccarat corresponding to panel 500. Panel 500 includes functional buttons corresponding to popular and common bets in Baccarat, such as player bet control 511, banker bet control 512, tie bet control 513, player pair bet 514, banker pair 515, and re-bet control 516. These functional buttons may be operable in response to user input to create a wager for the user on the underlying game, and may be used be the user to indicate participation in the game. In some embodiments, the user may tap or click these controls to make a corresponding wager at a default or currently selected chip value.

The functionality included in the playable view panel when in the multi-table view may be reduced with respect to the fuller functionality and information included in an expanded, full view of the game instance. For example, the compact user interface of playable view panel 500 omits some bonus bets offered in the game of Baccarat, which may be available in an expanded user interface. The user may be required to navigate to the full user interface to place less popular and/or less common bets.

Panel 500 may also include information content corresponding to the state of the game, such as countdown timer display element 520, bet value display element 521, last win amount display element 522, game phase element display element 525, and other suitable information about the underlying game. Countdown timer display element 520 may display a current amount of time remaining on a countdown timer, which may be decremented at regular intervals. Upon expiration of the countdown timer, a round of the underlying game may be performed and a result may be determined, as described above with respect to FIG. 3.

Panel 500 may also include a trend display element 530 to inform users about the outcomes of past rounds of the game. Trend display element 530 may allow a user to assess potential trends, which some users use to decide which tables to play on. Trend display element 530 may display any suitable trend and/or historical information about the underlying game instance. For example, trend display element 530 may include statistical information about results since the game play instance started, or may include a display of the most recent outcomes. In the illustrated example where panel 500 corresponds to a game of Baccarat, trend display element 530 may display a "main road" trend chart which tracks player wins, banker wins, and ties.

Similarly, trend information included in the playable view panel when in the multi-table view may be reduced with respect to the fuller trend information included in an expanded, full view of the game instance. The electronic gaming system may track other trends and data about the game, such as a "side road" trend chart in Baccarat. But this information may be omitted in the compact user interface of panel 500, which may require the user to navigate to the full user interface to view this additional information.

Figure 5B:
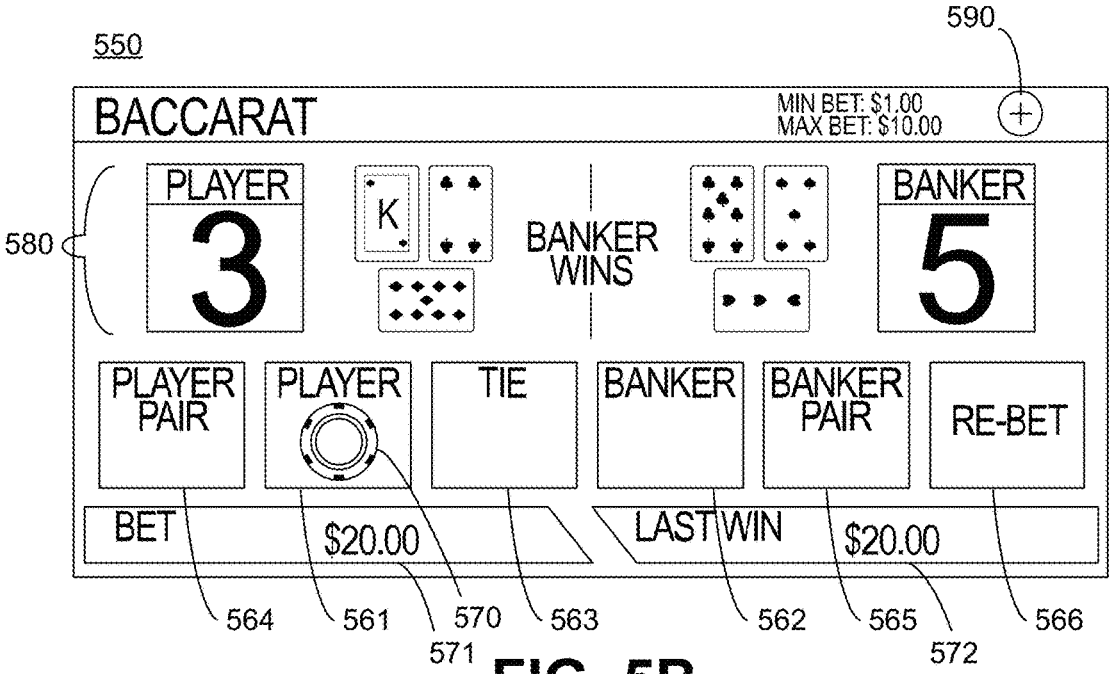

FIG. 5B depicts an illustrative playable view panel 550 corresponding to the Baccarat game type, in an active state. That is, the user has indicated participation in the game instance, such as through input indicating the user desires a wager on the underlying game of Baccarat corresponding to panel 550. Panel 550 may include functional buttons corresponding to the same popular and common bets in Baccarat, such as player bet control 561, banker bet control 562, tie bet control 563, player pair bet 564, banker pair 565, and re-bet control 566, although the active state panel may include additional and/or different functionality from that included in the inactive state panel. These functional buttons may be operable in response to user input to create a wager for the user on the underlying game, and may be used be the user to indicate participation in the game. In some embodiments, the user may tap or click these controls to make a corresponding wager at a default or currently selected chip value.

Panel 550 may also include information content corresponding to the state of the game. Information content included in the active state panel may be different from that included in the inactive state panel. Some information may remain the same, such as bet amount display element 571 and last win display element 572, as illustrated in FIG. 5B. But other information may change or be omitted. For example, trend data displays may be reduced in size or content, or omitted as in FIG. 5B. As another example, active panel 550 may include a current game result display element 580. Of course, current game result display element 580 may also be included in inactive panel 500 as well.

The displayed information in active and inactive panels may also vary based on the state of the game. For example, if the game is in the "Place Your Bets" phase illustrated in FIG. 3, both an inactive panel and an active panel may include the countdown timer display element. But in the "No More Bets" phase, an active panel may be updated to display a live result of the game while the inactive panel may display a new countdown timer or an indication that the game is underway, for example.

Although FIGS. 5A and 5B depict example content of playable view panels corresponding to the Baccarat game type, it will be understood that other game types will have different content. For example, a playable view panel corresponding to the Blackjack game type may provide the user with the ability to play multiple pips/hands at once, on the same table. Blackjack panels may include other bets associated with that game type, such as double down or split. As another example, As yet another example, a Roulette game type panel may include popular bets such as red, black, even, odd, high, and low. But the playable view panel included in the multi-table view generally comprises a compact, reduced user interface associated with the game type and omits some additional functionality and/or information that is included in a full, expanded view of the game instance as described further herein. As one example, a Roulette playable view panel in the multi-table view may omit the full layout of 32 individual numbers for straight bets, requiring the player to navigate to the full, expanded user interface to access the straight bets.

Panels 500 and 550 are also illustrated as including expand controls 540 and 590. Each playable view panel in the multi-table view may include an expand control. The expand control may be operable to cause expansion of the corresponding panel as discussed further herein. In response to user input selecting the expand control, indicating a desire to expand the panel, the electronic gaming system may cause the particular playable view panel associated with the selected expand control to expand to display additional detail as discussed further herein. In the process, the expanded panel may replace one or more other panels on the display, such as by expanding to take up the entire playable view region 430.

Returning to FIG. 4, by displaying information and functionality corresponding to a plurality of game instances, the multi-table view in playable view region 430 allows a user to see, for example, 8 tables of a selected game type at once. The user may be able to follow and assess trends form each of the displayed games, and may use this information to select a game instance to play. It is noted that past results may have no effect on the results of later game rounds in some game types, and in other game types their impact may be very limited.

Playable view region 430 is illustrated as including 8 playable view panels. It should be understood that any number of playable view panels may be included in playable view region 430. However, screen size and processing power may limit the number of playable view panels that may be effectively included. As additional panels are added for additional game tables, each area may get proportionally smaller. If many playable view panels are included, each individual panel may not be afforded enough space to display sufficient information content to allow a user to effectively review the state of the game. Smaller panels may eventually lose functionality and not be useful to the player if, for example, the buttons become too small to select, not enough information about the game is displayed, or the text becomes too small to read. In one preferred embodiment, 8 playable view panels are used to provide a sufficient amount of functionality and information to users while still presenting the user with a wide range of options for game tables.

Tab display region 420 may include paging toggle 425, which may be operable to allow users to view additional game instances. Where the number of available tables exceeds the number of tables playable view region 430 can display concurrently, paging toggle 425 may allow users to advance to a next page of tables. Responsive to user selection of paging toggle 425, indicating a desire to view additional tables, the electronic gaming device may update playable view region 430 to replace the plurality of playable view panels with a new second plurality of playable view panels corresponding to the next page of game instances. In some implementations, a single tap on the paging toggle 425 may advance to the next page of available games.

User interface 400 may further include player credit region 440. Player credit region 440 may display information corresponding to a balance of the user and provide one or more controls operable to adjust a wager placed by the user. For example, player credit region 440 may include an indication of the player's cash balance in the electronic gaming system. Player credit region 440 may also include an indication of a total bet amount current placed by the player across all games offered by the system (including games not currently displayed, such as games on a different page). Player credit region 440 may also include various chip denominations (or other indication of value) allowing the player to adjust an amount of a wager. In some embodiments, the player may drag chips or other indicators of value to the appropriate betting controls in the playable view panels to place a corresponding wager. Content of the credit region 440 may change based on context. For example, a total bet amount may be displayed when in multi-table view mode, but a single table bet amount may be displayed when the player has caused a single game to be expanded according to aspects described herein.

When in an initial state, user interface 400 may display less than all the illustrated regions prior to initial input from a player, in some implementations. For example, user interface 400 may be replaced with a splash screen or attract mode display until a user begins interacting with the electronic gaming device. As another example, user interface 400 may initially include tab display region 420 allowing a user to select a game type but may omit playable view region 430 until the user selects a game. In other embodiments, a popular game type may be selected by default, or pursuant to operator configuration.

Figure 6:
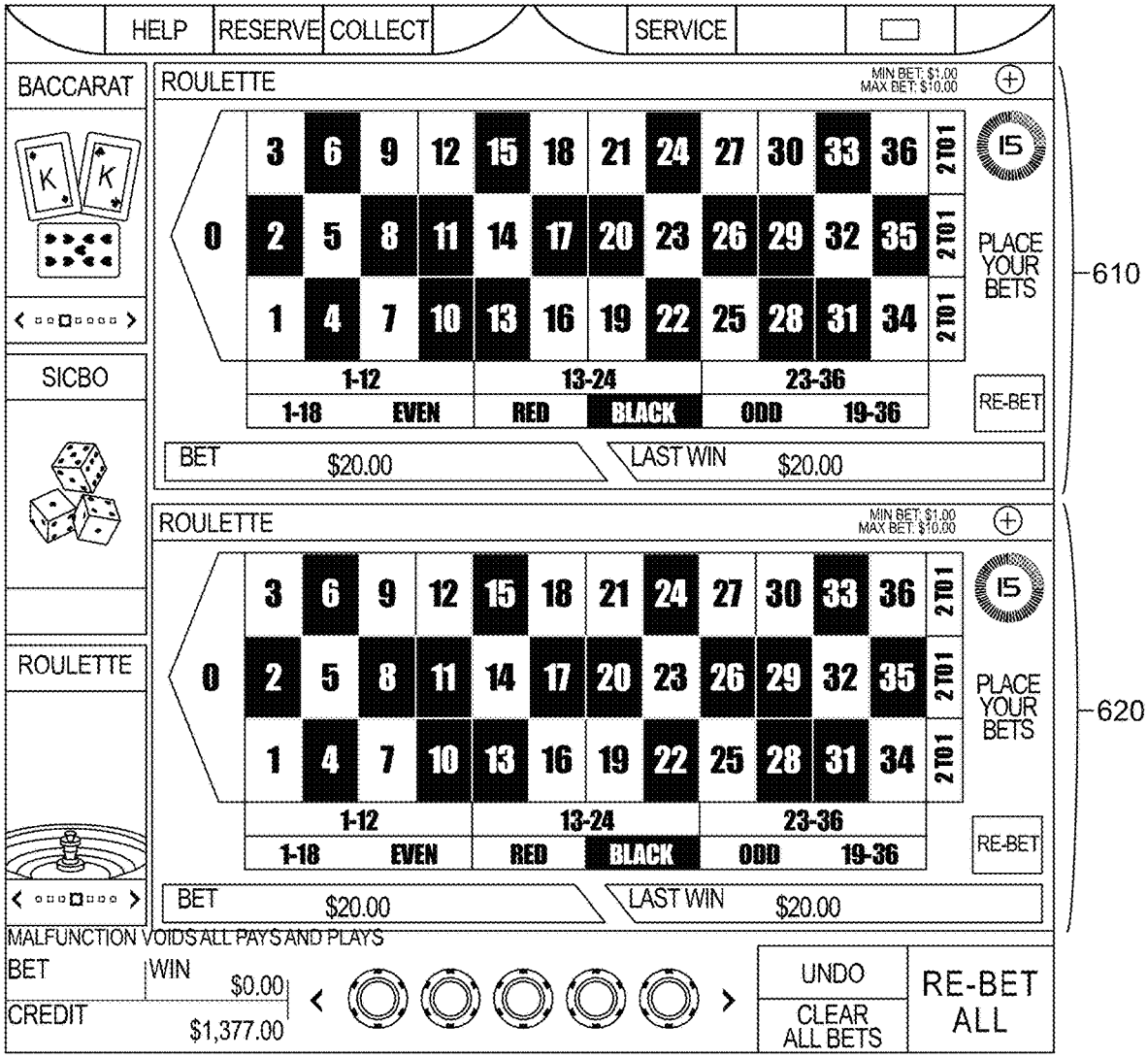
FIGS. 6 and 7 illustrate other example user interfaces with a multi-table view, according to some aspects described herein.

Although the example of FIG. 4 and user interface 400 is illustrated using 8 tables of Baccarat, is should be readily understood that other game types may be selected from the tab display region and be displayed in a multi-table view on playable view region. For example, FIG. 6 depicts another example user interface 600 where the user has selected the Roulette game type from the tab display region. User interface 600 comprises two playable view panels for the Roulette game type, panel 610 and panel 620. Roulette may require comparably more screen space to display enough content to allow a user to effectively interact with the compact user interface presented by the playable view panel in a multi-table view, as compared to Baccarat. Thus, in user interface 600, only two tables of Roulette are displayed at a time. As with Baccarat, the user may be able to operate a next page toggle to view additional game instances. Although the example illustrated in FIG. 6 depicts two playable view panels occupying the display region, split horizontally, it should be understood that any suitable layout may be used based on the gameplay information to be displayed. For example, a display with two Baccarat tables (or any other game type) may be split vertically rather than horizontally.

Figure 7:
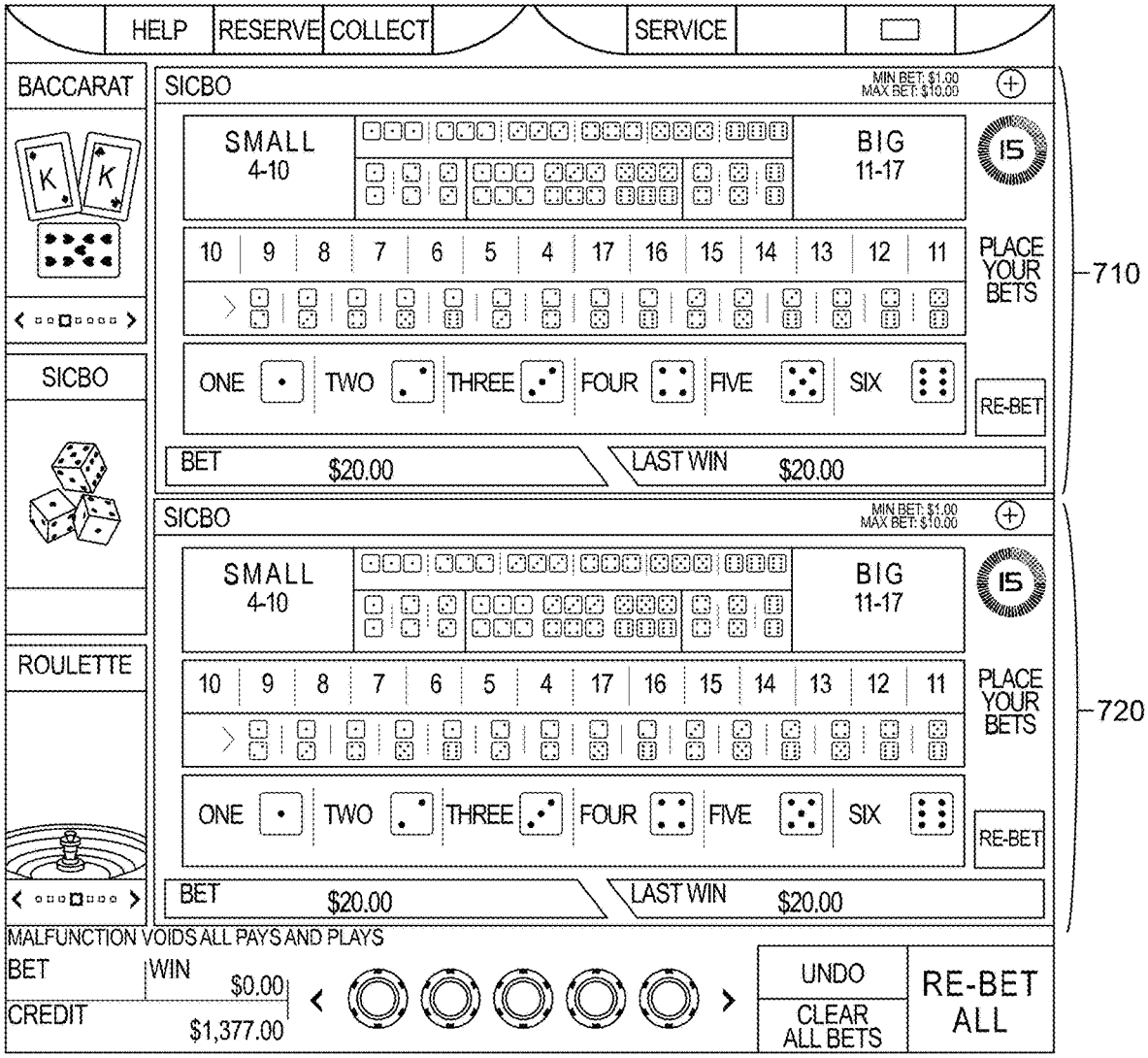

As another example, FIG. 7 depicts a user interface 700 where the user has selected the Sic Bo game type from the tab display region. User interface 700 similarly comprises two playable view panels for the Sic Bo game type, panels 710 and 720. Sic Bo, like Roulette, may require more screen space for an effective compact user interface that Baccarat does.

It should thus be readily appreciated that aspects described herein are not limited to a particular number of displayed tables or any particular shape, size, or layout of a playable view panel. And, as described later herein with respect to FIG. 11, aspects described herein are not limited to a uniform display of a single game type or shape of playable view panels.

Discussion so far has centered on the compact user interfaces provided by each playable view panel corresponding to the game instances displayed in the multi-table view. As discussed above, each playable view panel in the multi-table view provides a compact user interface offering a reduced set of functionality and information associated with the game type. This reduced set of functionality may omit some less common bets or trend information other than the most common trend information, for example. Some users may desire to drill down into a particular game instance and view an expanded user interface corresponding to that game instance. A user may select an expand control associated with a particular user interface and the electronic gaming system may modify the display of the playable view region to focus on the selecting game instance. An example of this expanded user interface is shown in FIG. 8.

Figure 8:
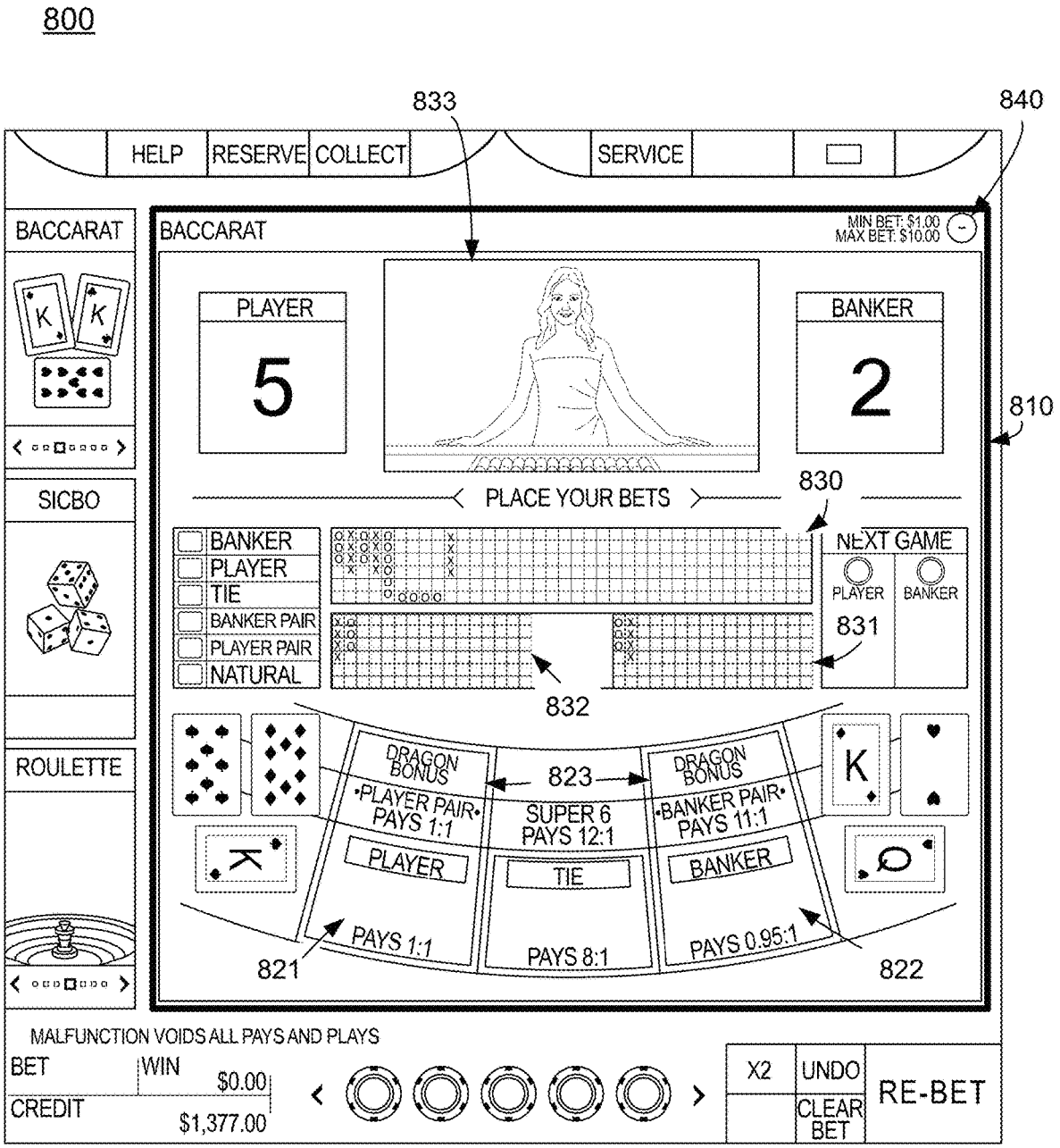
FIGS. 8 and 9 illustrate an example user interface providing more detailed information about a selected table, according to some aspects described herein.

FIG. 8 depicts a user interface 800 comprising an expanded playable view panel 810.

In the example illustrated in FIG. 8, the player has selected to expand a playable view panel corresponding to a game instance of the Baccarat game type. In response to the user selecting the expand control on a compact playable view panel in the multi-table view, the electronic gaming system may expand the playable view panel to take up a greater portion of the user interface and provide additional information/functionality. The expanded panel may replace the display of other playable view panels from the multi-table view, devoting more screen space to the selected game and allowing the player to focus on the selected game. In a preferred embodiment, the expanded panel may occupy the entire playable view region.

Expanded panel 810 includes more information and functionality than a corresponding compact playable view panel, such as playable view panel 432 of FIG. 4 and panel 550 of FIG. 5B. For example, in addition to the popular bets that were included in panel 550, such as player bet control 821 and banker bet control 822 expanded panel 810 also includes bonus bet controls 823. As another example, expanded panel 810 includes a "main road" trend display element 830 (similar to trend display element 530 of FIG. 5A), but also includes additional "side road" trend display elements 831 and 832. And the expanded panel 810 may include other additional information content, such as video content 833. The video content may depict, for example, a live dealer operating the game instance. In other implementations and/or contexts, the video content may be prerecorded video of a dealer, computer generated video of a dealer, video of a table corresponding to the game instance, and/or other suitable video content. Still other game information may be displayed in expanded panel 810, such as an indication of other players also participating in the game instance.

Expanded panel 810 also includes a reduce control 940, operable to cause the expanded panel to be reduced back into a compact playable view panel and reveal the other playable view panels in the multi-table view. In response to user selection of the reduce control 940, the electronic gaming device may remove the additional information associated with expanded panel 810 from the display and replace the expanded panel with a corresponding playable view panel, such as playable view panel 432.

Figure 9:
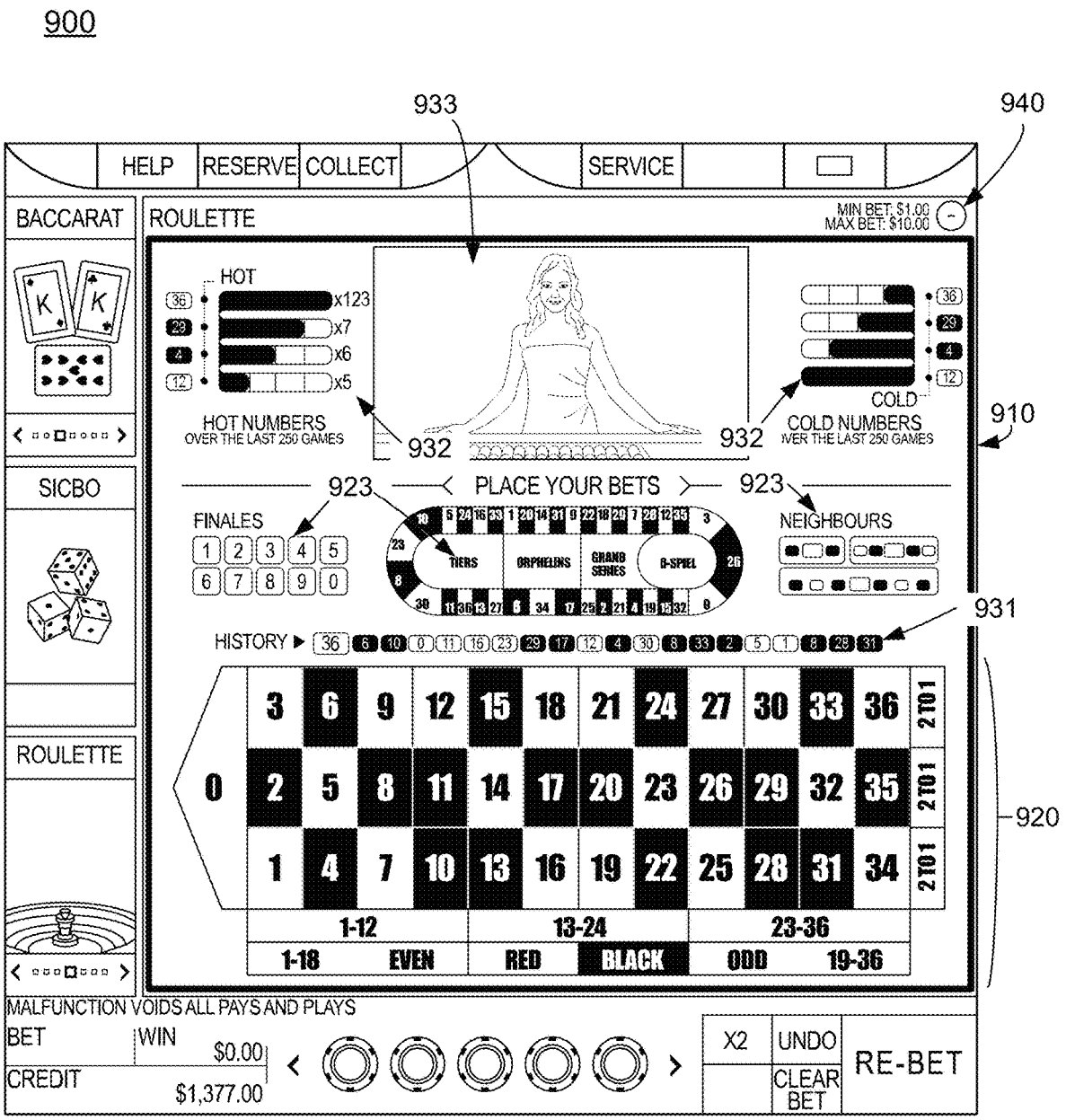

As noted above with respect to the example compact playable view panels depicted in FIGS. 5A and 5B, the expanded game panel may correspond to whatever game type has been selected by the user. For example, FIG. 9 illustrates a user interface 900 comprising an expanded panel 910 for a Roulette game instance. The expanded panel 910 may be displayed responsive to a user selecting an expand control of a Roulette game type panel, such as panel 610 of FIG. 6. Expanded panel 910 may include a full display of the single numbers 920 on the Roulette wheel, allowing the player to place straight bets, similar to that displayed in the compact view of panel 610. But expanded panel 910 may also offer additional betting options such as finales, neighbours, and various group bets through betting controls 923. And expanded panel 910 may offer additional views of the table, such as a track view of the numbers. Similarly, expanded panel 910 may present a recent results trend display element 931 similar to that displayed in panel 610, but may also present hot and cold trend display elements 932 and dealer video content 933.

Figure 10:
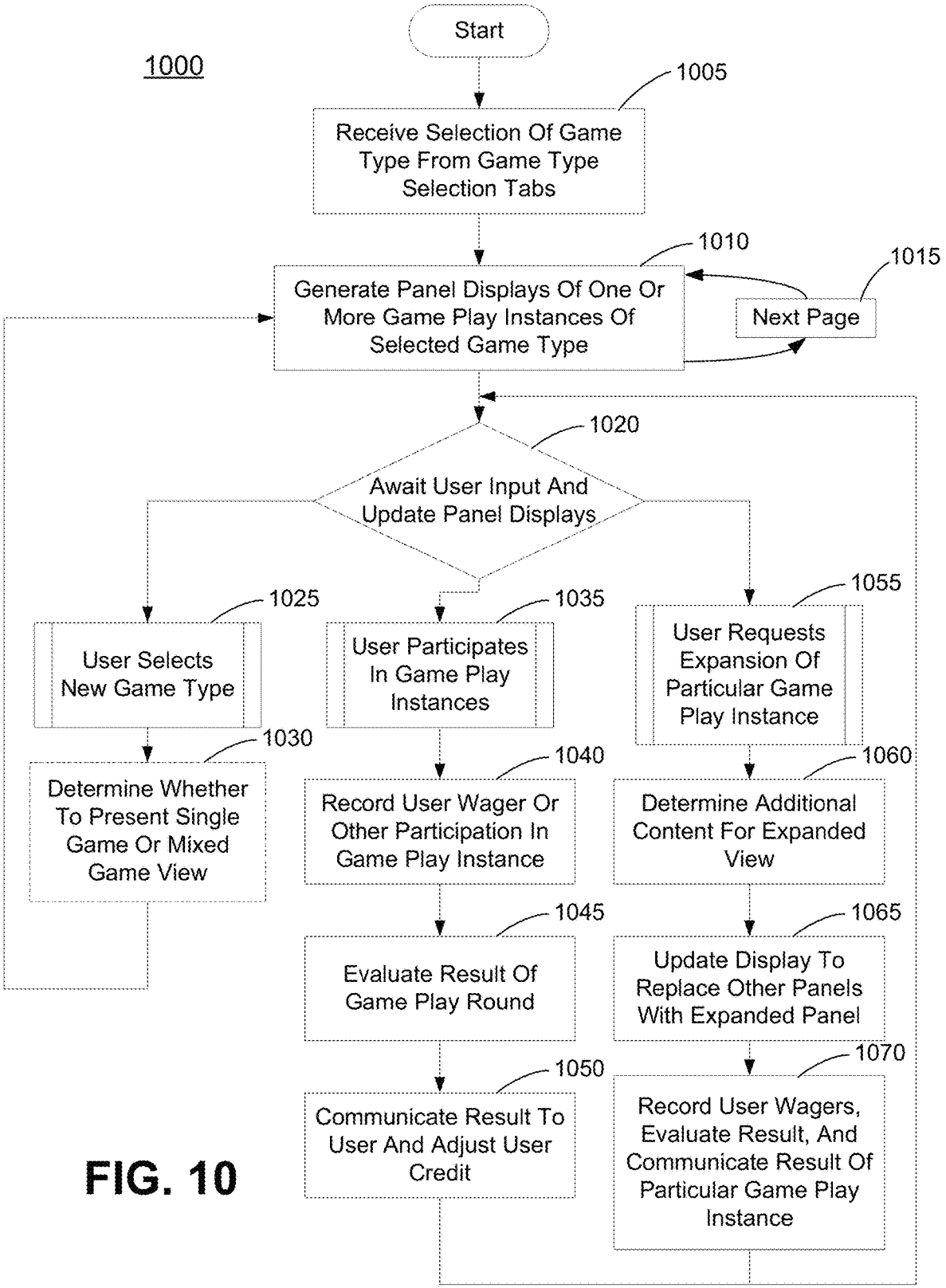
FIG. 10 illustrates an example method for providing a gaming user interface with multi-table view features, according to some aspects described herein.

Having discussed example user interfaces and the user's progression through those user interfaces, including a display of a multi-table view comprised of playable view panels and a drill-down control to view additional information and functionality corresponding to a particular game instance, discussion will now turn to a method according to some aspects herein as illustrated in FIG. 10.

FIG. 10 depicts a method 1000 of operating a game selection menu to provide multi-table view features, in accordance with the foregoing discussion. Method 1000 may be implemented on an electronic gaming device, such as player terminal 110 of FIG. 1. Other suitable electronic gaming devices may include any suitable computing device, such as a desktop computer, laptop computer, mobile device, tablet, and the like. Output generated by method 1000 may be displayed on a display device coupled to the electronic gaming device, such as a touchscreen or other suitable display.

At step 1005, the electronic gaming device may receive a selection of a game type via an input device (e.g. a touchscreen, a mouse, a button, and the like) from a plurality of game types displayed in a tab display region of a user interface. The device may display a plurality of tabs in the tab display region corresponding to different game types. For example, the game types may be any of: Baccarat, Blackjack, Roulette, Sic Bo, Big 6, Craps, Pai Gow Poker, Three Card Poker, and the like.

At step 1010, the device may generate one or more playable view panel displays to populate a playable view region. Each playable view panel may correspond to a respective game play instance of the selected game type. The game play instances may comprise a set of live and/or virtual tables of the selected game type offered by the operator of the electronic gaming system. Each playable view panel may comprise a compact user interface associated with the selected game type, and may allow the user to directly participate in the underlying game instance without having to navigate to a different screen. The information included in each playable view panel may comprise information about the state of the game instance and trend information based on past results of the game instance. Thus, a user may view the plurality of playable view panels to assess recent results and determine which game play instances/tables to participate in. Functionality included in each playable view panel may allow the user to interact with the underlying game play instance and indicate their participation in that game, such as by placing a wager on an outcome of that game. The functionality included in the playable view panel may be less than all the functionality included in an expanded, full user interface associated with the selected game type.

At step 1015, the device may receive user input requesting the user interface advance to the next page of game instances having the selected game type. The user input may indicate that the user operated a paging toggle corresponding to a particular game type. In response, the device may update the playable view region to replace the plurality of playable view panels with a different plurality of playable view panels correspond to additional game instances on the next page of games, and processing may continue.

At step 1020, the device may await user input while continuing to update the playable view panels based on activity in the underlying game instances. For example, a playable view panel may comprise a timer display element corresponding to the underlying game play instance. The device may update the timer display element at regular intervals (e.g., every second) as a timer counts down the remaining time until a next round of the game instance will be played. The device may also include a trend display element based on past game play results of the underlying game play instance. The trend display element may be updated based on new results each time the timer expires and a new result is obtained. In some implementations, the device may provide different information and/or functionality in playable view panels that are inactive (where the user is not participating) or active (where the user is participating and/or has an active wager).

In response to receiving user input, the device may take the appropriate steps corresponding to the operation indicated by the user input. User input may indicate a request for a particular function through the user's selection of a display element and/or control associated with the particular function.

At step 1025, where user input is received selecting a new game type, the device may update the playable view area to display one or more playable view panels corresponding to the selected new game type, returning to step 1010. According to some embodiments discussed further below with respect to FIG. 11, the device may determine whether the user input indicates that the user desires a mixed game view instead of a single game view at step 1030, and may update the playable view region accordingly.

At step 1035, where user input is received indicating the user is participating in one or more of the game play instances via the playable view panels, the system may record a wager or other form of participation in the game play instance, proceeding to step 1040. In particular, functionality included in the compact user interface of the plurality of playable view panels allows the user to indicate a wager or other participation in a particular game play instance directly on the corresponding playable view panel while other playable view panels are concurrently displayed. The user input, received via the input device, may comprise a selection (e.g., a tap, click, button press, and/or dragging of a betting element) on an element of the playable view panel associated with a wager and/or other betting functionality. An appropriate bet, corresponding to the selected functionality, will be made in the underlying game instance of the playable view panel receiving the user input. Additionally, other functionality on the user interface may allow the user to adjust the wager, such as by changing a denomination of chips used to place bets. A user may drag representations of chips to betting regions in a particular playable view panel to place a corresponding bet.

At step 1045, the device and/or a broader electronic gaming system in which the device participates may evaluate a result of a game play round. As described above, the electronic gaming system may utilize a timer to determine when to perform a round of each game instance. Upon expiration of the timer, the system may perform a round of the game and evaluate a result of the round. At step 1050, this result may be communicated to the user and the user's credit balance may be adjusted. For example, if the user wins the wager then the user's balance may be increased accordingly. Processing then may return to step 1020 where the device awaits further user input.

At step 1055, where the device receives user input requesting expansion of a particular game play instance, the device may expand the corresponding playable view panel, proceeding to step 1060. At step 1060, the device may determine additional content for the expanded view of the game instance. As discussed above, the expanded view of the game instance may include additional content, such as additional information and/or functionality, relative to the limited information and functionality already provided in the playable view panel. For example, the device may determine that the expanded user interface for the selected game type includes an additional game play option not included in the compact user interface view prior to the expansion. As another example, the device may determine that the expanded user interface for the selected game type includes additional information elements, such as video content associated with the underlying game instance and similarly not included in the playable view panel prior to expansion. User input indicating a request to expand the particular game instance may comprise user input selecting an expand control corresponding to the particular playable view panel.

At step 1065, the device may update the display of the playable view region to replace other playable view panels with the expanded panel corresponding to the selected game index. In some implementations, the expanded panel may occupy the entirety of the playable view region. This expansion may be performed in response to the user input requesting the expansion of the particular playable view panel. The display of the expanded view panel may include the additional content, which was not depicted prior to the selected playable view panel being expanded.

At step 1070, the device may provide the user with a full user interface as to the selected game instance via the expanded panel. Similar to prior art electronic game devices, the user may be allowed to play the single game instance and make appropriate wagers while being presented with appropriate game information. The device may record wagers received from the user, evaluate results of game rounds of the particular game instance, and communicate results of that particular game instance to the user. However, the display may still offer the user the option to change game types via the tab display region, and the expanded panel may include a control allowing the user to return to the multi-table view (not shown). Upon operation of the reduce control, indicating that the user wants to return to the multi-table view, the device may return to step 1010 and display the plurality of playable view panels again.

Figure 11:
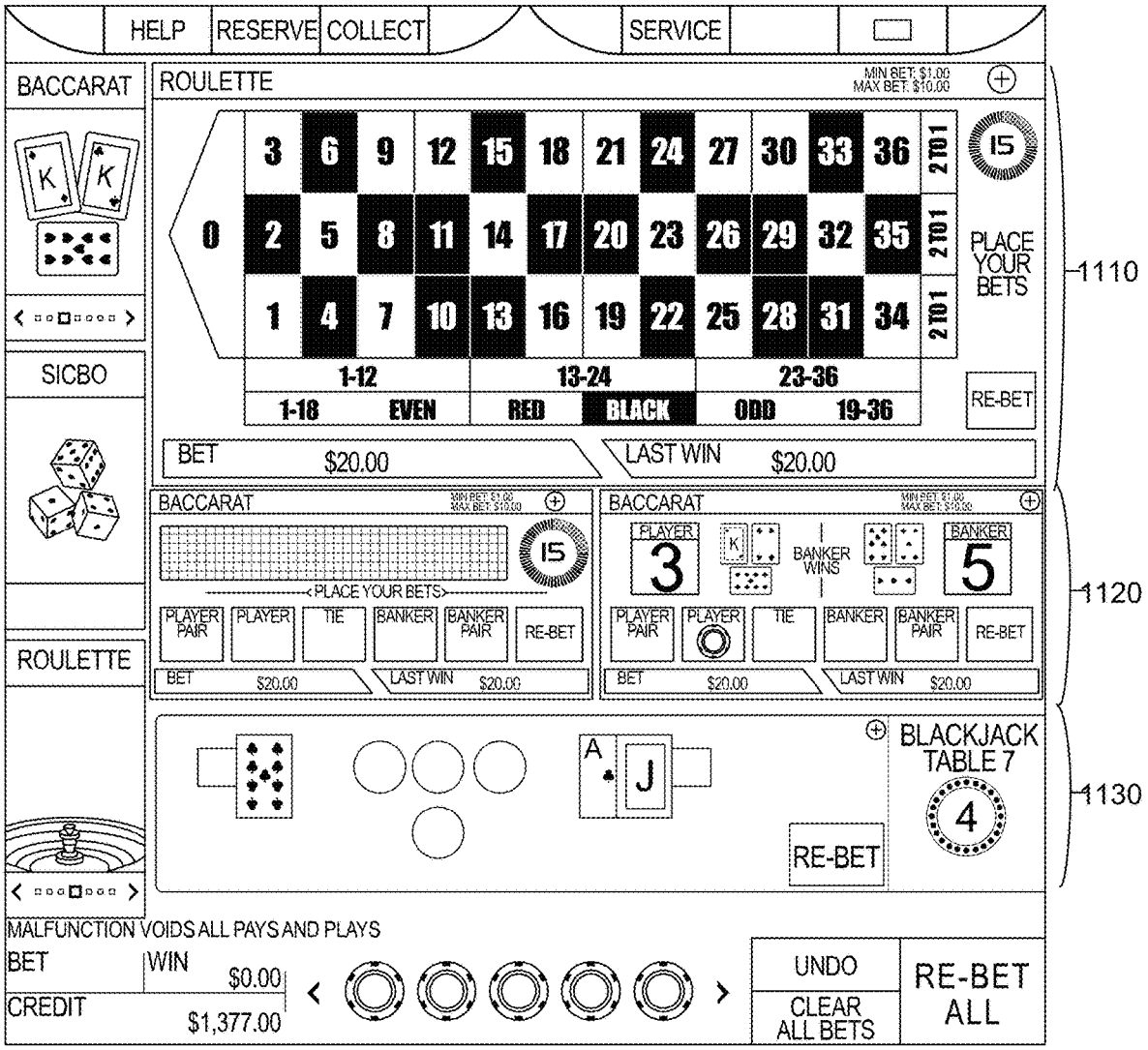
FIG. 11 illustrates an example user interface with a multi-table view offering mixed game types, according to some aspects described herein.

Having discussed a method of operating a game selection menu, discussion will now turn to support for mixed game types in the multi-table view, as illustrated in FIG. 11.

FIG. 11 depicts a user interface 1100 comprising playable view panels corresponding to three different game types. In the example illustrated in FIG. 11, panel 1110 corresponds to an instance of the Roulette game type, region 1120 corresponds to two panels of the Baccarat game type, and panel 1130 corresponds to an instance of the Blackjack game type. Although many players prefer to play a single type of game, some players may desire to play several different types of games concurrently. This mixed-type, multi-table view may allow interested players to participate in multiple games of multiple types from a single user interface. This may be advantageous where no seats are available at a first game type desired by the user (e.g. Blackjack), as the user may be allowed to play a second game type (e.g. Roulette) while watching for a seat to come available at a table of the first game type. This may also be advantageous where the user desires to take a break from one game to "change their luck" by playing another game type for a short while.

As in the single-type multi-table view, each playable view panel includes functionality and information allowing the player to assess the state of each game and make wagers without needing to navigate to a focused, full user interface associated with a particular game. But, similarly to the single-type multi-table view, each panel may include an expand control operable to drill down into a particular game instance and expand the panel corresponding to the selected game instance.

As illustrated in FIG. 11, the playable view panels may be in any suitable shape and have different content based on the type of game involved. For example, the Roulette panel 1110 is large to allow for the display of a full numbers layout, taking up nearly half the playable view region. The Baccarat panels 1120 are each small, needing less space to communicate enough information to allow the user to play the games. And the Blackjack panel 1130 is a medium size, allowing sufficient room to allow players to place wagers on multiple pips/hands simultaneously.

The layout and type of each panel in the playable view region may be configurable by the user. User interface 1100 may provide controls allowing the user to add or remove tables from the playable view region. For example, the tab display region may include controls allowing the user to indicate whether they want a single-game type experience for a selecting game or want to add a single instance of the game to a mixed-type multi-table view.

According to some aspects, the size and layout of playable view panels need not be fixed. The electronic gaming device may automatically determine a size and/or layout for each playable view panel based on a current number of displayed games and display parameters (e.g. resolution, screen size). For example, if only two Baccarat tables are available, the playable view panels may automatically be resized to each take up half of the playable view region. For example, two Baccarat tables may be displayed side-by-side, with one taking up a left half of the display area while the other occupies the right half. Further, the device may re-arrange the displayed tables in response to user input or automatically. For example, the user interface may provide controls allowing the user to select and reposition a playable view panel, such as by dragging the playable view panel to a desired location and swapping screen positions with another panel. Or, as another example, the device may automatically rearrange the tables to prioritize and/or group the game instances in which the player is currently participating.

Each game type may be associated with one or more compact user interfaces suitable for use in displaying the playable view panels in the multi-table view. For example, a small user interface having a small set of functionality may be used when displaying 8 Baccarat tables concurrently, while a medium user interface having a larger set of functionality may be used when displaying 4 Baccarat tables concurrently.

Aspects described herein may be implemented on computing devices specially configured to perform the steps and functionality explained above. Suitable computing devices may include one or more processors, which may execute instructions of a computer program to perform any of the features described herein. The instructions may be stored in any type of computer-readable medium or memory, to configure the operation of the processor. For example, instructions may be stored in a read-only memory (ROM), random access memory (RAM), removable media, such as a Universal Serial Bus (USB) drive, compact disk (CD) or digital versatile disk (DVD), floppy disk drive, or any other desired storage medium. Instructions may also be stored in an attached (or internal) hard drive. The computing device may include one or more output devices, such as a display (e.g., a computer monitor), and may include one or more output device controllers, such as a video processor. There may also be one or more user input devices, such as a remote control, keyboard, mouse, touch screen, microphone, camera input for user gestures, etc. The computing device may also include one or more network interfaces, such as a network input/output (I/O) circuit (e.g., a network card) to communicate with an external network. The network input/output circuit may be a wired interface, wireless interface, or a combination of the two.

Portions of the foregoing describe hardware configurations, although the components discussed herein may be wholly or partially implemented as software as well. Modifications may be made to add, remove, combine, divide, etc. components of the various computing devices and servers as desired. Additionally, the components discussed herein may be implemented using basic computing devices and components, and the same components (e.g., processor, ROM storage, display, etc.) may be used to implement any of the other computing devices and components described herein. For example, the various components herein may be implemented using computing devices having components such as a processor executing computer-executable instructions stored on a computer-readable medium. Some or all of the entities described herein may be software based, and may co-exist in a common physical platform (e.g., a requesting entity can be a separate software process and program from a dependent entity, both of which may be executed as software on a common computing device).

One or more aspects of the disclosure may be embodied in a computer-usable data and/or computer-executable instructions, such as in one or more program modules, executed by one or more computers or other devices. Generally, program modules include routines, programs, objects, components, data structures, etc. that perform particular tasks or implement particular abstract data types when executed by a processor in a computer or other data processing device. The computer executable instructions may be stored on one or more computer readable media such as a hard disk, optical disk, removable storage media, solid state memory, RAM, etc. As will be appreciated by one of skill in the art, the functionality of the program modules may be combined or distributed as desired in various embodiments. In addition, the functionality may be embodied in whole or in part in firmware or hardware equivalents such as integrated circuits, field programmable gate arrays (FPGA), and the like. Particular data structures may be used to more effectively implement one or more aspects of the disclosure, and such data structures are contemplated within the scope of computer executable instructions and computer-usable data described herein.

Although example embodiments are described above, the various features and steps may be combined, divided, omitted, rearranged, revised and/or augmented in any desired manner, depending on the specific outcome and/or application. Various alterations, modifications, and improvements will readily occur to those skilled in art. Such alterations, modifications, and improvements as are made obvious by this disclosure are intended to be part of this description though not expressly stated herein, and are intended to be within the spirit and scope of the disclosure. Accordingly, the foregoing description is by way of example only, and not limiting. This patent is limited only as defined in the following claims and equivalents thereto.

What is claimed is:

1. A method of operating a game selection menu, comprising:

displaying, on a display device, a plurality of game type tabs in a tab display region, wherein each tab of the plurality of game type tabs corresponds to a respective different game type;

receiving, via a user input device, a first user input indicative of a selection of a first tab of the plurality of game type tabs to thereby select a first game type corresponding to the selected first tab;

displaying, in response to the first user input and on the display device, a plurality of playable view panels in a playable view region adjacent to the tab display region, wherein:

each playable view panel of the plurality of playable view panels corresponds to a respective game play instance of the first game type, and at least one of the plurality of playable view panels comprises an inactive panel comprising:

a trend display element based on at least one past game play result of a respective game play instance corresponding to the inactive panel; and a timer element associated with the respective game play instance corresponding to the inactive panel;

updating the display of the timer element of the inactive panel at regular intervals;

updating, in response to expiration of the timer element, the trend display element to indicate an additional game play result of the respective game play instance;

receiving, via the user input device, second user input within at least one first panel of the plurality of playable view panels and indicative of a first wager in at least one first game play instance corresponding to the at least one first panel;

receiving, via the user input device, a third user input indicative of a selection of a second panel of the plurality of playable view panels;

expanding, in response to the third user input, the second panel within the playable view region such that the expanded second panel replaces one or more other panels of the plurality of playable view panels and depicts additional game content that was not depicted prior to the second panel being expanded; and receiving, via the user input device, a fourth user input indicative of a second wager in the second panel, wherein the first wager and the second wager are made in concurrent games.

2. The method of claim 1, wherein the selected first tab includes a paging toggle, the method further comprising:

receiving, via the user input device, a fifth user input indicative of a selection of the paging toggle; and replacing, in response to the fifth user input and on the display device, the plurality of playable view panels in the playable view region with a different plurality of playable view panels of the first game type.

3. The method of claim 1, wherein the additional game content comprises at least one additional game play interaction option, associated with a second game play instance corresponding to the second panel, that was not depicted prior to the second panel being expanded.

4. The method of claim 1, wherein the additional game content comprises video content, associated with a second game play instance corresponding to the second panel, that was not depicted prior to the second panel being expanded.

5. The method of claim 1, wherein the selected second panel is one of the at least one first panels.

6. The method of claim 1, wherein the expanded second panel occupies the entire playable view region.

7. The method of claim 1, wherein the plurality of playable view panels comprises two playable view panels, and wherein the two playable view panels occupy the entire playable view region and are split horizontally or vertically.

8. The method of claim 1, wherein the plurality of playable view panels comprises eight playable view panels.

9. The method of claim 1, wherein the second user input indicative of the wager in the at least one first game play instance corresponding to the at least one first panel comprises user input selecting a betting element on the at least one first panel.

10. The method of claim 1, wherein the playable view region is displayed horizontally adjacent to the tab display region, the method further comprising:

displaying, on the display device, a player credit region adjacent to the tab display region and the playable view region, wherein at least one control in the player credit region is operable to adjust an amount of the wager.

11. The method of claim 1, wherein the game types corresponding to the plurality of game type tabs comprise Baccarat, Sic Bo, and Roulette.

12. The method of claim 1, wherein the first game type is Baccarat and the additional game content comprises a bonus wager element.

13. The method of claim 1, wherein the first game type is Roulette and the additional game content comprises a single number wager element.

14. An apparatus comprising:

one or more processors;

a display device;

a user input device; and memory storing instructions that, when executed by the one or more processors, cause the apparatus to:

display, on the display device, a plurality of game type tabs in a tab display region, wherein each tab of the plurality of game type tabs corresponds to a respective different game type;

receive, via the user input device, a first user input indicative of a selection of a first tab of the plurality of game type tabs to thereby select a first game type corresponding to the selected first tab;

display, in response to the first user input and on the display device, a plurality of playable view panels in a playable view region adjacent to the tab display region, wherein:

each playable view panel of the plurality of playable view panels corresponds to a respective game play instance of the first game type, and at least one of the plurality of playable view panels comprises an inactive panel comprising:

a trend display element based on at least one past game play result of a respective game play instance corresponding to the inactive panel; and a timer element associated with the respective game play instance corresponding to the inactive panel;

update the display of the timer element of the inactive panel at regular intervals;

update, in response to expiration of the timer element, the trend display element to indicate an additional game play result of the respective game play instance;

receive, via the user input device, second user input within at least one first panel of the plurality of playable view panels and indicative of a first wager for at least one first game play instance corresponding to the at least one first panel;

receive, via the user input device, a third user input indicative of a selection of a second panel of the plurality of playable view panels;

expand, in response to the third user input, the second panel within the playable view region such that the expanded second panel replaces one or more other panels of the plurality of playable view panels and depicts additional game content that was not depicted prior to the second panel being expanded; and receive, via the user input device, a fourth user input indicative of a second wager in the second panel, wherein the first wager and the second wager are made in concurrent games.

15. The apparatus of claim 14, wherein the additional game content comprises at least one second trend display element, associated with a second game play instance corresponding to the second panel, that was not depicted prior to the second panel being expanded, and wherein the second trend display element has additional content relative to the first trend display element.

16. At least one non-transitory computer readable medium comprising instructions that, when executed by one or more processors, cause the one or more processors to:

cause display, on a display device, of a plurality of game type tabs in a tab display region, wherein each tab of the plurality of game type tabs corresponds to a respective different game type;

receive, via a user input device, a first user input indicative of a selection of a first tab of the plurality of game type tabs to thereby select a first game type corresponding to the selected first tab;

cause display, in response to the first user input and on the display device, of a plurality of playable view panels in a playable view region adjacent to the tab display region, wherein:

each playable view panel of the plurality of playable view panels corresponds to a respective game play instance of the first game type, and at least one of the plurality of playable view panels comprises an inactive panel comprising:

a trend display element based on at least one past game play result of a respective game play instance corresponding to the inactive panel; and a timer element associated with the respective game play instance corresponding to the inactive panel;

update the display of the timer element of the inactive panel at regular intervals;

update, in response to expiration of the timer element, the trend display element to indicate an additional game play result of the respective game play instance;

receive, via the user input device, second user input within at least one first panel of the plurality of playable view panels and indicative of a first wager for at least one first game play instance corresponding to the at least one first panel;

receive, via the user input device, a third user input indicative of a selection of a second panel of the plurality of playable view panels;

expand, in response to the third user input, the second panel within the playable view region such that the display of the expanded second panel replaces one or more other panels of the plurality of playable view panels and depicts additional game content that was not depicted prior to the second panel being expanded, wherein the additional game content comprises at least one additional wager option, associated with a second game play instance corresponding to the second panel, that was not depicted prior to the second panel being expanded; and receive, via the user input device, a fourth user input indicative of a second wager in the second panel, wherein the first wager and the second wager are made in concurrent games.

17. The computer readable medium of claim 16, wherein the instructions, when executed by the one or more processors, further cause the one or more processors to:

receive, via the user input device, fifth user input indicative of a request to add a third panel corresponding to an instance of a second game type to the playable view region, wherein the second game type is different from the first game type; and cause display of the third panel corresponding to the second game type in the playable view region concurrently with the plurality of playable view panels.

* * * * *